US009210982B2

(12) United States Patent
Alsalameh

(10) Patent No.: US 9,210,982 B2
(45) Date of Patent: Dec. 15, 2015

(54) LIQUID-DISPENSING COMB

(71) Applicant: UMM AL-QURA UNIVERSITY, Makkah (SA)

(72) Inventor: Saleh Alsalameh, Qassim (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 0 days.

(21) Appl. No.: 14/218,889

(22) Filed: Mar. 18, 2014

(65) Prior Publication Data

US 2015/0265025 A1 Sep. 24, 2015

(51) Int. Cl.

| | |
|---|---|
| ***A45D 24/22*** | (2006.01) |
| *A45D 24/24* | (2006.01) |
| *A45D 24/00* | (2006.01) |
| *A46B 11/00* | (2006.01) |

(52) U.S. Cl.

CPC ..... *A45D 24/22* (2013.01); *A45D 24/00* (2013.01); *A45D 24/24* (2013.01); *A46B 11/0058* (2013.01)

(58) Field of Classification Search

CPC ..... A45D 24/22; A45D 24/28; A45D 24/00; A45D 24/02; A45D 24/04; A45D 24/10; A45D 24/12; A45D 24/14; A45D 24/24; A45D 2200/054; A45D 2200/055; A45D 2200/0056; A46B 11/0058

USPC ..... 132/112–116, 207, 208

See application file for complete search history.

(56) References Cited

U.S. PATENT DOCUMENTS

| | | | | | |
|---|---|---|---|---|---|
| 1,362,780 | A | * | 12/1920 | Chapman | 132/112 |
| 1,629,389 | A | * | 5/1927 | Johnson | 132/114 |
| 1,645,038 | A | | 10/1927 | Borer | |
| 1,829,021 | A | * | 10/1931 | Sinclair | 132/113 |
| 1,833,293 | A | | 11/1931 | Laguionie | |
| 1,891,471 | A | | 12/1932 | Fotza | |
| 2,235,637 | A | | 3/1941 | Hickey | |
| 2,336,717 | A | * | 12/1943 | Crimmins | 401/22 |
| 2,381,048 | A | * | 8/1945 | Habostad | 132/113 |
| 2,603,223 | A | * | 7/1952 | Jefferson | 132/108 |
| 2,609,821 | A | | 9/1952 | Weissberger | |
| 2,772,434 | A | * | 12/1956 | Solomon | 15/176.4 |
| 2,794,443 | A | * | 6/1957 | Moore | 132/113 |
| 3,137,305 | A | | 6/1964 | Jones | |
| 3,295,537 | A | * | 1/1967 | Young, Jr. | 132/113 |
| 3,721,250 | A | | 3/1973 | Walter et al. | |

(Continued)

FOREIGN PATENT DOCUMENTS

| | | |
|---|---|---|
| EP | 0043519 | 1/1982 |
| EP | 0097322 | 1/1984 |
| FR | 2422359 | 11/1979 |

*Primary Examiner* — Robyn Doan

(74) *Attorney, Agent, or Firm* — Richard C. Litman

(57) ABSTRACT

The liquid-dispensing comb includes a liquid reservoir in the handle and/or spine thereof, with the teeth of the comb being hollow to allow liquid to flow from the reservoir into the teeth. Outlets are provided along the sides of the teeth rather than at their distal tips, to distribute liquid to the hair strands as the comb is passed therethrough, rather than to the scalp of the person using the comb. Various embodiments include pneumatic devices for pressurizing the reservoirs of the combs, thus forcing liquid to flow from the outlets along the sides of the teeth. Another embodiment includes an internal plate with a series of stops thereon, the stops fitting into corresponding passages at the bases of the teeth. A handle extends from the spine of the comb, enabling the user to manipulate the internal plate to control flow from the reservoir and into the teeth.

1 Claim, 9 Drawing Sheets

(56) References Cited

U.S. PATENT DOCUMENTS

| | | | | | |
|---|---|---|---|---|---|
| 4,090,522 | A * | 5/1978 | Donley et al. | 132/112 |
| 4,121,602 | A * | 10/1978 | Young | 132/113 |
| 4,319,852 | A * | 3/1982 | Bell et al. | 401/185 |
| 5,297,882 | A * | 3/1994 | Kornides | 401/184 |
| 5,339,839 | A | 8/1994 | Forcelledo et al. | |
| 5,483,979 | A | 1/1996 | Bertieri | |
| 6,260,557 | B1 * | 7/2001 | Yarbrough | 132/208 |
| 8,118,036 | B2 | 2/2012 | Wang et al. | |
| 2006/0243292 | A1 | 11/2006 | Roger | |

* cited by examiner

LIQUID-DISPENSING COMB

BACKGROUND OF THE INVENTION

1. Field of the Invention

The present invention relates to personal hygiene and grooming aids, and particularly to a liquid-dispensing comb for applying various liquids to the hair. The comb is particularly adapted for the application of hair dyes to the hair, while avoiding application of dye to the underlying scalp.

2. Description of the Related Art

Innumerable variations of combs, hair brushes, and the like have been developed in the past. Many such devices have been developed for some specific purpose, i.e., to solve some problem in the field of grooming and hair care. While routine, day-to-day hair care, i.e., combing and brushing, is generally a single step process requiring the use of only a single tool or device (comb, brush, etc.), the need or desire for more involved hair treatment may require several steps.

An example of hair treatment is a process of coloring or dying the hair. Many persons wish to change the color of their hair, perhaps as a change of pace or to go with a new wardrobe, a change of the season, or for some special occasion. Specialized hair dyes have been developed in the past specifically for this purpose. However, the application of such dyes is generally a rather involved process, usually requiring various steps to provide a relatively good result. Moreover, merely working the dye into the hair generally may not produce an optimum result, as the relatively thin and watery liquid dye flows to the base or roots of the hair strands (as is desired) and then flows out onto the scalp, which can result in an artificial appearance for the person thus treated.

Accordingly, various tools and devices for the application of dyes and/or other substances to the hair have been developed in the past. An example of such is found in French Patent Publication No. 2,422,359 published on Nov. 9, 1979 to Gilles Farcy, which publication describes two embodiments of a comb having a liquid reservoir in the handle. The liquid reservoir communicates with a longitudinal passage extending along the spine of the comb, with this passage further communicating with a passage provided through each hollow tooth of the comb. The various passages terminate at the distal tips of the teeth of the comb.

Another example is found in European Patent Publication No. 0097322 published on Jan. 4, 1984 to Laszlo Kelemen. This reference describes a hair brush having a hollow body with a plurality of hollow bristles extending therefrom. The distal ends or tips of the bristles are open to apply nutritive substances directly onto the scalp.

Thus, a liquid-dispensing comb addressing the aforementioned problems is desired.

SUMMARY OF THE INVENTION

A liquid-dispensing comb includes various embodiments, with each having a liquid reservoir in the handle and/or the spine of the comb. The teeth of the comb are also hollow, with a passage extending through each tooth and communicating with the liquid reservoir of the handle and/or spine. Outlets are provided along the sides of the teeth to distribute the liquid (dye, etc.) from the reservoir out through the sides of the teeth for application to the strands of hair as the comb is passed therethrough. The tips of the teeth are solid, with no dye or other liquid flowing therethrough. The solid tips of the teeth preclude or substantially preclude the application of dye or other liquid directly to the scalp, with the liquid distributed by the comb being applied primarily to the strands of hair as the comb passes therethrough.

One embodiment of a liquid-dispensing comb includes a pneumatic pressure bulb extending from the spine of the comb, for pressurizing the liquid reservoir within the comb. Another embodiment of a liquid-dispensing comb includes an internal plate with a plurality of stops extending therefrom, with each stop corresponding to a passage extending through one of the teeth of the comb. A handle extends through a passage in the spine of the comb, allowing a user of the comb to manipulate the handle (and thus the internal plate) to control the flow of liquid from the reservoir out through the hollow teeth. Yet another embodiment of a liquid-dispensing comb has a reservoir in the handle, with a small pushbutton operated pneumatic pump or control located at a suitable location near the base of the handle to pressurize the internal reservoir of the comb. The handle may be separable from the comb in this latter embodiment, to provide for filling the handle with dye or other liquid. Further embodiments include dispensing mechanisms in the handles to dispense liquids contained in reservoirs within the handles.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

The liquid-dispensing comb includes various embodiments, with each embodiment having a reservoir therein for the storage of a hair treatment liquid or the like and a plurality of hollow teeth communicating with the reservoir. Each of the teeth has a plurality of laterally disposed pores therein, for distributing the hair treatment liquid from the comb. The distal ends of the teeth are solid, i.e., non-porous, to preclude or substantially preclude dispensing of the liquid directly onto the scalp as the comb is passed through the hair of the user.

Figure 1:
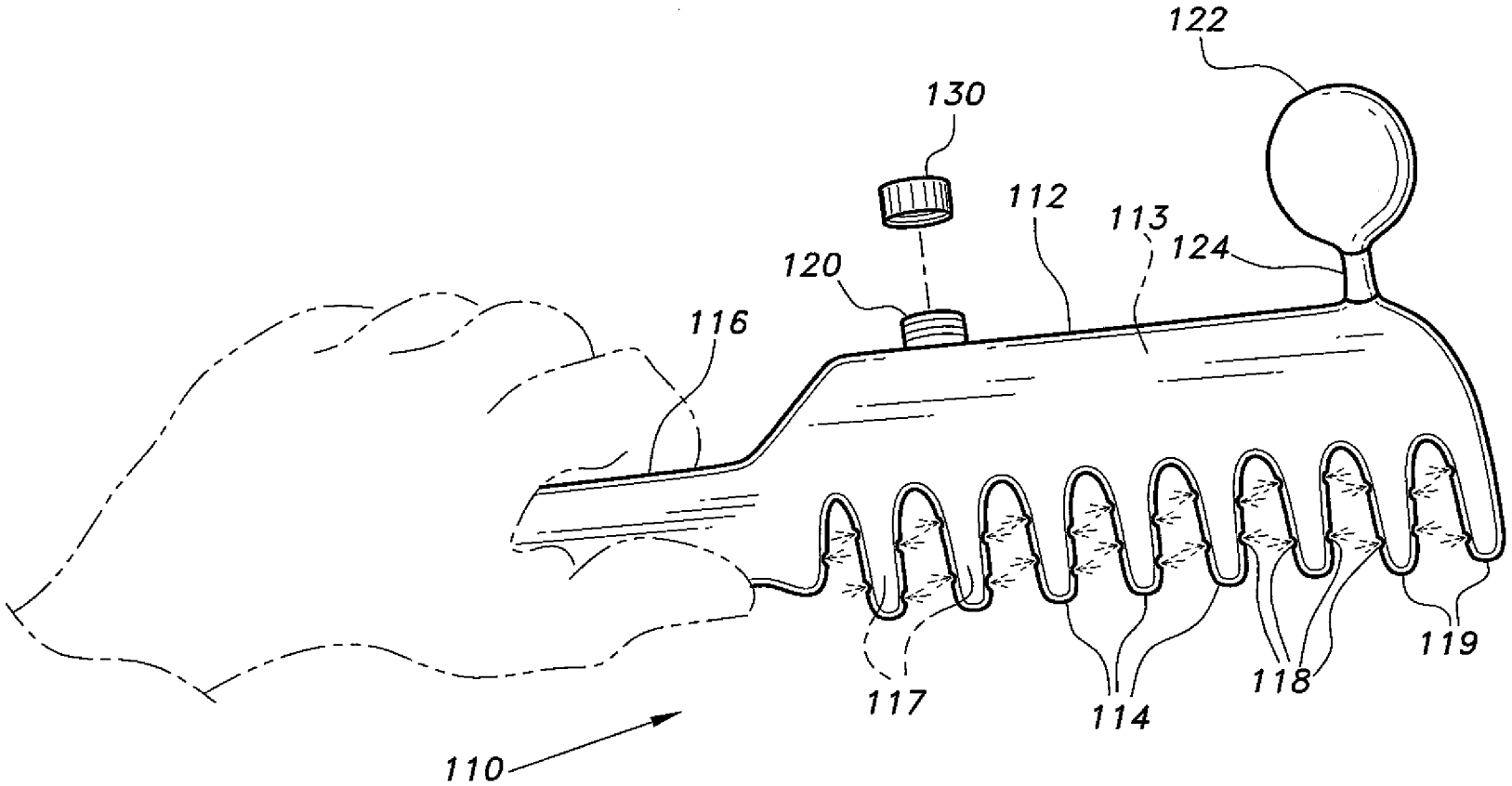
FIG. 1 is an environmental right side elevation view of a first embodiment of a liquid-dispensing comb according to the present invention.

FIG. 1 of the drawings provides a right side elevation view of a first embodiment liquid-dispensing comb 110. The comb 110 includes a hollow spine 112 defining an internal cavity or reservoir 113 therein (similar to the hollow spine 212 including the reservoir 222 shown generally in FIG. 2), with a plurality of hollow teeth 114 extending from the spine 112 and generally normal thereto. A handle 116 extends from one end of the spine 112, for manipulating the comb 110. The handle 116 may be a solid component, or in various embodiments may include a hollow structure to provide a liquid reservoir. Each of the teeth 114 is hollow or substantially hollow, with a fluid passage 117 extending therethrough. The fluid passages 117 communicate with the internal cavity of the spine 112. Each of the teeth further includes a plurality of small laterally disposed pores 118, with the pores 118 distributed along substantially the length of each of the teeth 114, such as being distributed along the entirety of the length of each of the teeth 114, for example. However, the distal ends or tips 119 of the teeth are solid, i.e., non-porous, to preclude or substantially preclude placement of any of the pores 118 upon or immediately adjacent to the scalp as the comb 110 is being used. Each of the pores 118 communicates with the internal passage 117 of its respective tooth 114, to allow liquid to flow from the cavity 113 of the spine 112, down the hollow passage 117 formed in each of the teeth 114, and out through the pores 118 in the sides of the teeth 114.

Hair treatment liquid or the like is poured into the hollow spine 112 through a filler neck or spout 120 in the top or back of the spine 112 and into the internal cavity or reservoir 113. A cap 130 is removed from the filler neck or spout 120 in the drawing of FIG. 1. When the cap 130 is installed to the filler neck or spout 120, the spine cavity or reservoir 113 is a relatively closed and sealed volume, with the exception of the small pores 118 along the sides of the teeth 114. A flow control member, such as a pneumatic bulb 122, is provided with the embodiment of the comb 110 of FIG. 1, allowing the user to pressurize the internal volume of the cavity or reservoir 113 of the spine 112 to force any liquid contained therein out from the pores 118 of the teeth 114. The pneumatic bulb 122 is desirably at least somewhat remotely disposed from the remainder of the comb 110 structure and external to the spine 112, generally as shown in FIG. 1. The connecting tube 124 between the bulb 122 and the spine 112 may be of various suitable lengths or dimensions, and can be longer or shorter than that shown in FIG. 1, if so desired, for example.

Figure 2:
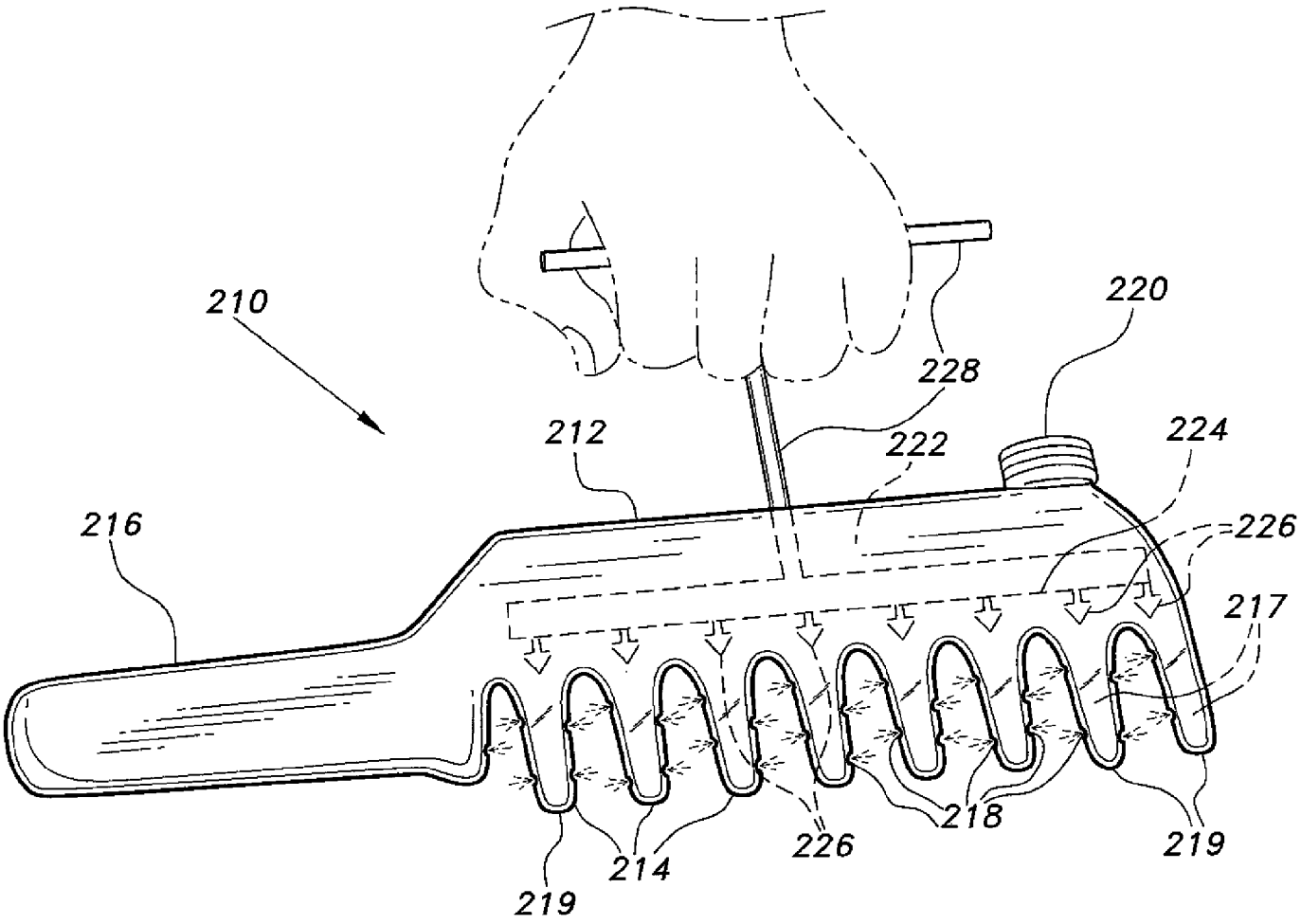
FIG. 2 is an environmental right side elevation view of a second embodiment of a liquid-dispensing comb according to the present invention.

Referring to FIG. 2, an embodiment of a liquid-dispensing comb 210 is illustrated and is configured generally as the embodiment of the liquid-dispensing comb 110 of FIG. 1. The liquid-dispensing comb 210 has a hollow spine 212, a series of teeth 214 extending from the spine 212 and substantially normal thereto, and a handle 216 extending from one end of the spine 212. As in the embodiment of the liquid-dispensing comb 110 of FIG. 1, each of the teeth 214 is hollow or substantially hollow, with a fluid passage 217 extending therethrough. The fluid passages 217 communicate with the internal cavity or reservoir 222 of the spine 212. Each of the teeth 214 further includes a plurality of small laterally disposed pores 218, with the pores 218 distributed along substantially the length of each of the teeth 214, such as being distributed along substantially the entirety of the length of each of the teeth 214. However, the distal ends or tips 219 of the teeth 214 are solid, i.e., non-porous, to preclude or substantially preclude placement of any of the pores 218 upon or immediately adjacent to the scalp as the comb 210 is being used. Each of the pores 218 communicates with the internal passage 217 of its respective tooth 214, to allow liquid to flow from the cavity or reservoir 222 of the spine 212, down the hollow passage 217 formed in each of the teeth 214, and out through the pores 218 in the sides of the teeth 214. A filler neck or spout 220 is provided in the top or back of the spine 212, similar to the embodiment of the liquid-dispensing comb 110 of FIG. 1. Hair treatment liquid or the like is poured into the hollow spine 212 through the filler neck or spout 220 in the top or back of the spine 212 and into the reservoir 222. A cap or other suitable closure member, such as the cap 130 of the liquid-dispensing comb 110 of FIG. 1, is removed from the filler neck or spout 220 in the drawing of FIG. 2. When the cap, or other suitable closure member, is installed to the filler neck or spout 220, the spine cavity or reservoir 222 is a relatively closed and sealed volume, with the exception of the small pores 218 along the sides of the teeth 214.

The hollow spine 212 defines a hair treatment liquid reservoir 222 therein, with the reservoir 222 extending substantially the length of the spine 212 as illustrated in FIG. 2, for example. An adjustably positionable plate 224 is installed within the reservoir 222, the plate 224 having a plurality of stops 226 depending therefrom. Each of the stops 226 corresponds with and is aligned with the respective upper opening or upper end of the passage 217 through one of the teeth 214, with movement of the plate 224 downward, i.e., toward the teeth 214, adjusting a position of the stops 226 and engaging the stops 226 in the upper ends of the internal passages 217 of the teeth 214 to stop or to decrease or to control the flow of hair treatment liquid from the reservoir 222. Lifting the plate 224 toward the back of the spine 212, adjusts a position of the stops and pulls the stops 226 from the upper ends of the tooth passages 217 to allow or increase or control liquid to flow from the reservoir 222 and into those passages 217 to be distributed from the pores 218 of the teeth 214. Control of the position of the plate 224 and the amount of liquid flowing to the pores 218 of the teeth 214 is accomplished by a flow control member, such as including a flow adjustment handle 228 in communication with the plate 224, the handle 228 extending through the back of the spine 212, with manipulation of the handle 228 controlling the position of the plate 224 and a position of the stops 226 to selectively control the liquid flow out of the pores 218, as described above.

Figure 3:
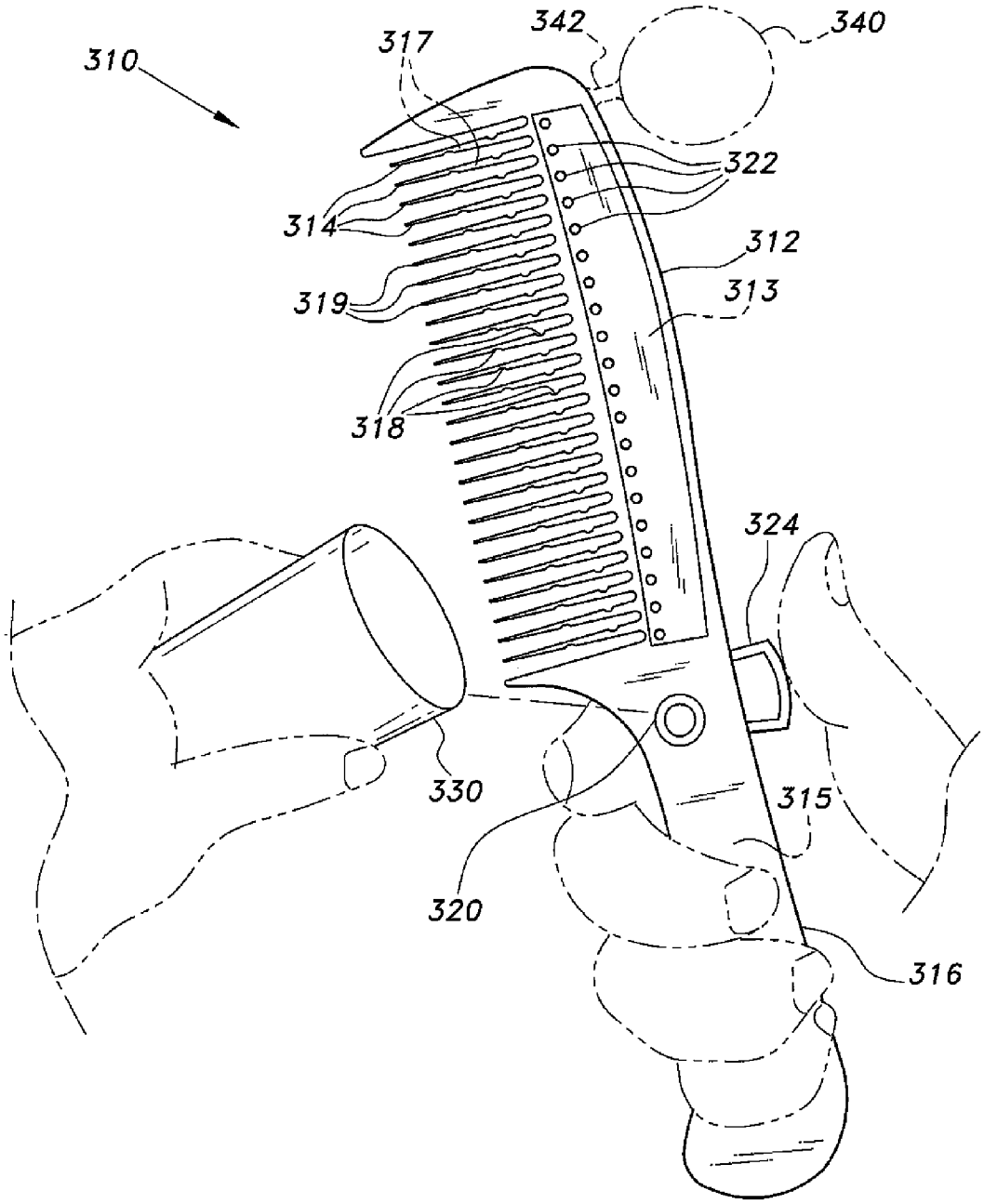
FIG. 3 is an environmental left side elevation view of a third embodiment of a liquid-dispensing comb according to the present invention.

Referring to FIG. 3 of the drawings, a left side elevation view of a third embodiment of a liquid-dispensing comb is illustrated, designated as a liquid-dispensing comb 310. The liquid-dispensing comb 310 is configured generally as the embodiments of the liquid-dispensing combs 110 and 210 of FIGS. 1 and 2. The liquid-dispensing comb 310 has a hollow spine 312, a series of teeth 314 extending from the spine 312 and substantially normal thereto, and a handle 316 extending from one end of the spine 312. As in the embodiments of the liquid-dispensing combs 110 and 210 of FIGS. 1 and 2, each of the teeth 314 is hollow or substantially hollow, with a fluid passage 317 extending therethrough. It will be seen that the teeth 314 of the comb 310 are relatively thinner than the teeth 114 and 214 of the embodiments of the liquid-dispensing combs 110 and 210 of FIGS. 1 and 2. But the liquid-dispensing comb 310 may use the relatively thicker teeth 114 and 214 of the embodiments of the liquid-dispensing combs 110 and 210 of FIGS. 1 and 2. Also, embodiments of the liquid-dispensing combs 110 and 210 may be manufactured with the relatively thinner teeth 314 of the embodiment of the liquid-dispensing comb 310, if desired, and should not be construed in a limiting sense. The fluid passages 317 of the teeth 314 communicate with an internal cavity or reservoir 313 of the spine 312, similar to the reservoir 222 of spine 212 of FIG. 2, for example. Each of the teeth 314 further includes a plurality of small laterally disposed pores 318, with the pores 318 distributed along substantially the length of each of the teeth 314, such as being distributed along substantially the entirety of the length of each of the teeth 314. However, the distal ends or tips 319 of the teeth 314 are solid, i.e., non-porous, to preclude or substantially preclude placement of any of the pores 318 upon or immediately adjacent to the scalp as the comb 310 is being used. Each of the pores 318 communicates with the internal passage 317 of its respective tooth 314, to allow liquid to flow from the cavity or reservoir 313 of the spine 312, down the hollow passage 317 formed in each of the teeth 314, and out through the pores 318 in the sides of the teeth 314.

The liquid-dispensing comb 310 of FIG. 3 differs from the embodiments of the liquid-dispensing combs 110 and 210 of FIGS. 1 and 2 in various ways. The liquid-dispensing comb 310 includes the internal cavity 313 in the spine 312, but the handle 316 is also hollow to provide a reservoir 315 for hair treatment liquid or the like, with the handle reservoir 315 being similar to the reservoir 222 depicted for the comb embodiment 210 shown in FIG. 2. The internal cavity 313 in the spine 312 is in communication with the reservoir 315 of the handle 316. Accordingly, the filler neck or spout 320 is located along the handle 316, desirably at or near the base thereof at its juncture with the spine 312, for example. The spine 312 also includes the internal cavity 313 extending substantially for the entire length thereof, with the internal cavity 313 also being similar to the reservoir 222 of the liquid-dispensing comb 210 of FIG. 2. A series of spinal pores 322 are distributed along the sides of the spine 312. The internal reservoirs or cavities 315 of the handle 316 and 313 of the spine 312 communicate with one another, and with the pores 318 of the teeth 314 and with the spinal pores 322 to distribute a hair treatment liquid therefrom.

Hair treatment liquid or the like is poured and communicatively flows into the internal cavity 313 of the spine 312 and into the reservoir 315 of the handle 316 through the filler neck or spout 320, such as from a suitable dispenser 330 of a liquid, such as a measurement cup, for example. A cap or other suitable closure member, such as similar to the cap 130 of the liquid-dispensing comb 110, is removed from the filler neck or spout 320 in the drawing of FIG. 3. When the cap, or other suitable closure member, is installed to the filler neck or spout 320, the internal cavity 313 in the spine 312 and the reservoir 315 in the handle 316 is a relatively closed and sealed volume, with the exception of the pores 318 along the sides of the teeth 314 and the series of spinal pores 322.

A pneumatic pressure control button or pump 324, as a flow control member, is provided at a convenient location on the handle 316 to allow the user to pump up the internal air pressure within the reservoir 315 of the handle 316 and the spinal reservoir and cavity 313 in the spine 312, to force the hair treatment liquid from either or both of the reservoir 315 and the spinal cavity 313 and out the various pores 318 and 322 to control a flow of a liquid out from the internal cavity 313 of the spine 312 in communication with the reservoir 315 of the handle 316. Also, a flow control member, such as, such as a pneumatic bulb 340, can be provided with the embodiment of the comb 310 of FIG. 3, allowing the user to pressurize, or to assist in pressurizing the internal volume of the internal cavity 313 of the spine 312, alone or in conjunction with the pneumatic pressure control button or pump 324, to force any liquid contained therein out from the pores 318 of the teeth 314 or out from the spinal pores 322 distributed along the sides of the spine 312. The pneumatic bulb 340 is desirably at least somewhat remotely disposed from the remainder of the comb 310 structure and external to the spine 312, generally as shown in FIG. 3. The connecting tube 342 between the bulb 340 and the spine 312 may be of various suitable lengths or dimensions, and can be longer or shorter than that of the connecting tube 124 shown in FIG. 1, if so desired, for example.

Figure 4:
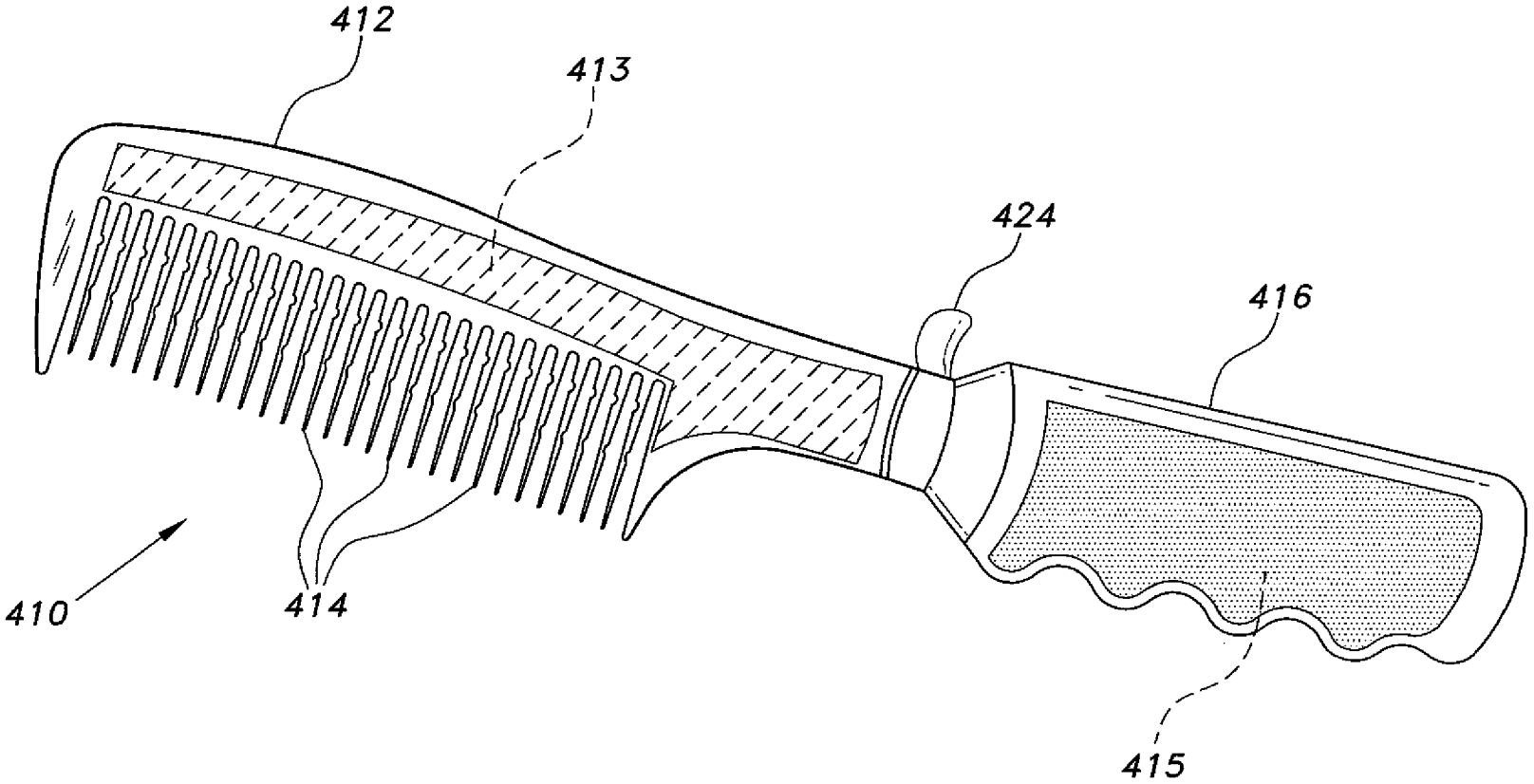
FIG. 4 is a perspective view of a fourth embodiment of a liquid-dispensing comb according to the present invention.
Figure 5:
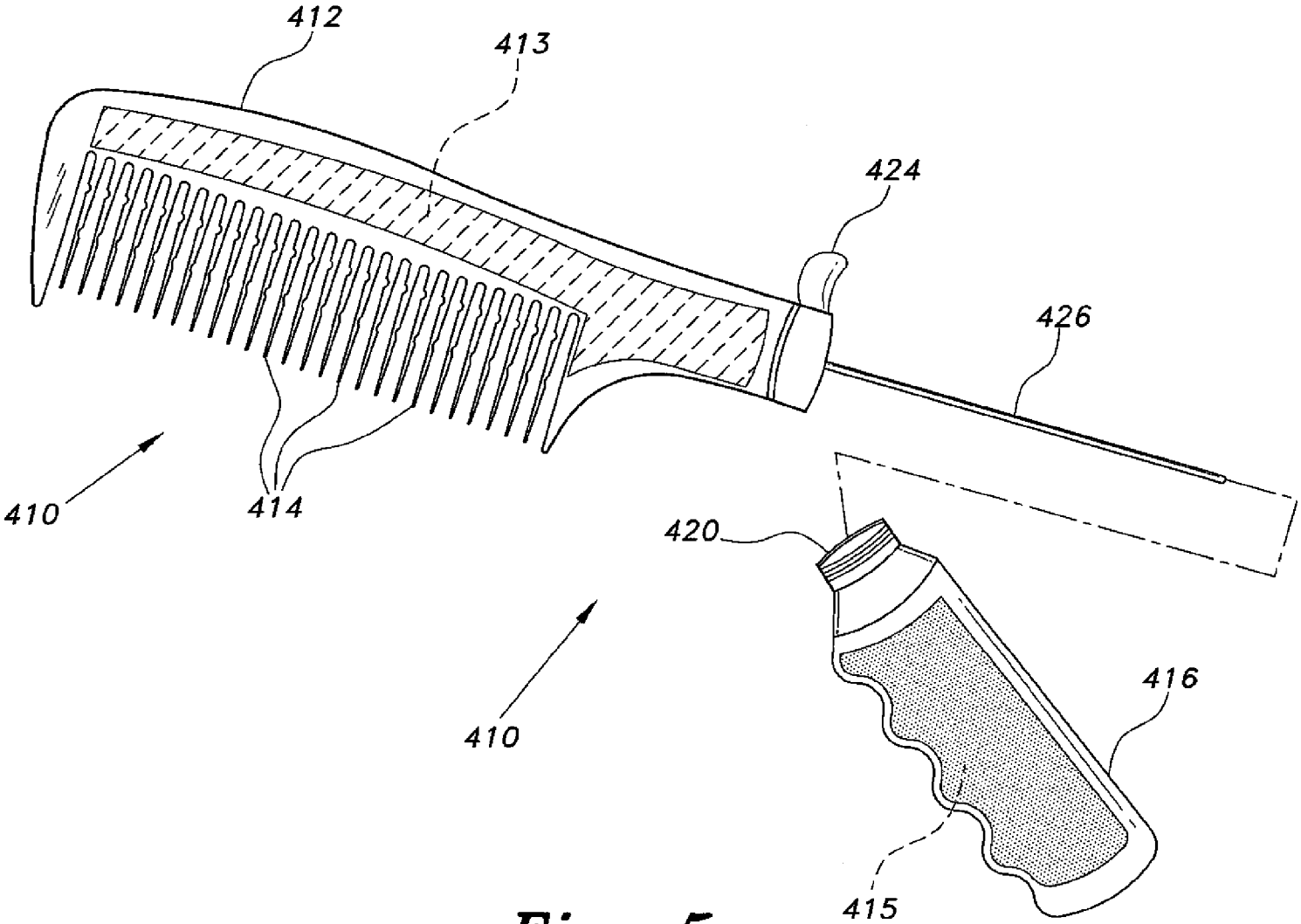
FIG. 5 is an exploded perspective view of the embodiment of FIG. 4, illustrating the separation of the hollow liquid containing handle from the comb.

FIGS. 4 and 5 of the drawings illustrate yet another embodiment of the liquid-dispensing comb, designated as liquid-dispensing comb 410. The comb 410 is configured somewhat similarly to the comb 310 of FIG. 3. The comb 410 has a spine 412 and a plurality of hollow, porous teeth 414. Each of the teeth has a solid, closed tip and a plurality of lateral pores (not shown in FIGS. 4 and 5, but similar to the pores 318 of the comb 310 embodiment of FIG. 3). A hollow removable handle 416 is attached to the base of the spine 412. The hollow liquid containing cavity 415 within the handle 416 communicates with the hollow cavity 413 along the spine 412 and down the hollow teeth 414, as in the liquid-dispensing comb 310 of FIG. 3. The spine 414 may include a plurality of pores therealong (not shown in FIGS. 4 and 5, but similar to the pores 322 of the comb 310 of FIG. 3). A pneumatic pump 424, similar to the pump 324 of the comb embodiment 310 of FIG. 3, is provided at the juncture of the handle 416 and spine 412 to allow the user to pressurize the internal volume of the handle 416 and other volumes with which it communicates to expel any liquid therein from the pores of the teeth 414 of the comb 410.

The base of the handle portion 416 is threaded and threads into the cooperatively threaded base of the spine 412, as shown in FIG. 5 of the drawings. The threaded base of the handle 416 serves as an opening 420 for the addition of a liquid, e.g., hair dye, etc., to the hollow interior of the handle. An elongate pickup tube 426 extends from the base of the spine 412 through the hollow interior 415 of the handle 416 to draw liquid from the extreme end of the handle opposite its attachment base to the spine 412.

Figure 6:
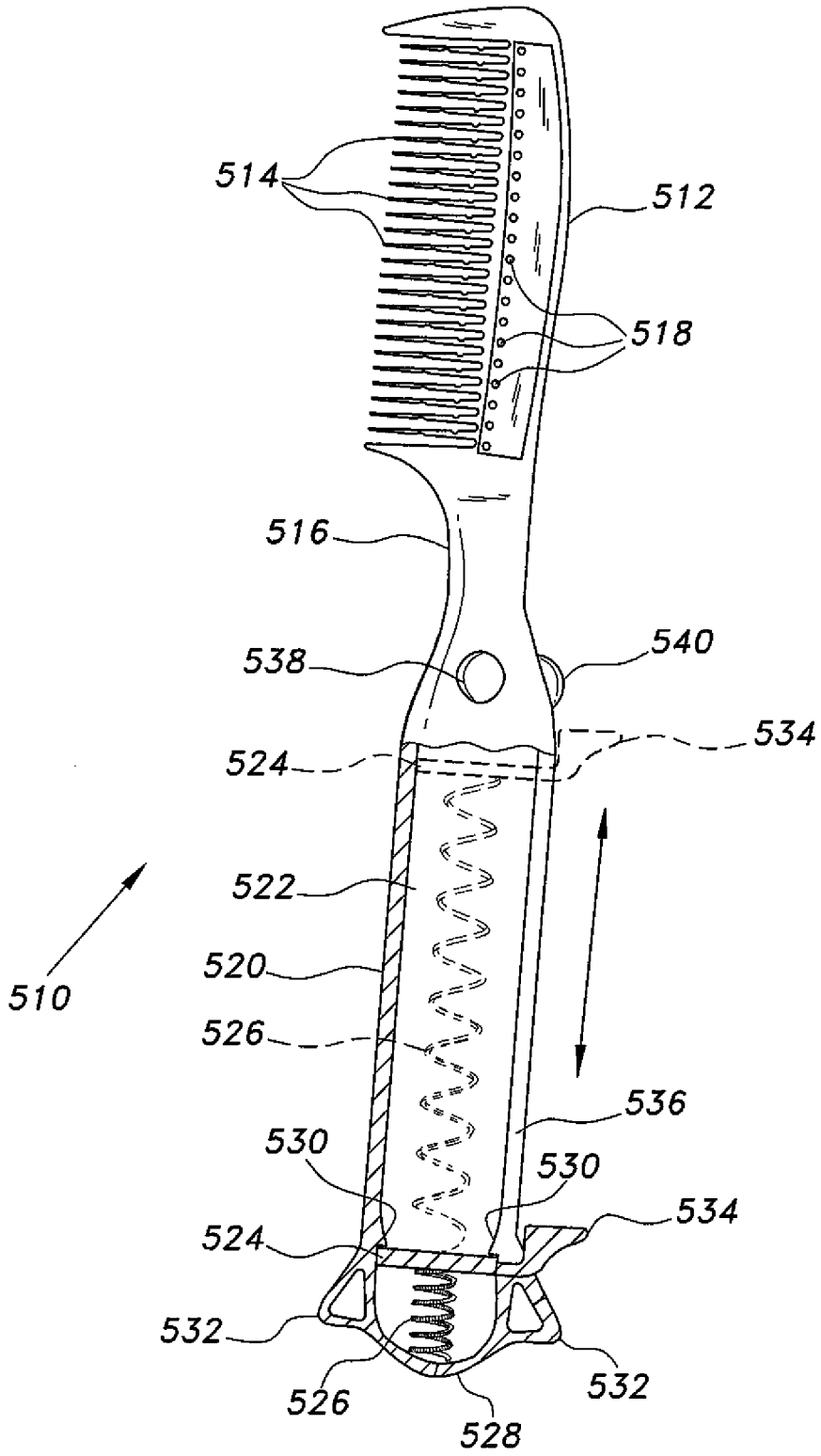
FIG. 6 is a perspective view of a fifth embodiment of a liquid-dispensing comb according to the present invention, broken away and in partial section, illustrating a spring mechanism disposed within the handle to dispense liquid from a reservoir contained within the handle.

FIG. 6 of the drawings provides an illustration of a further embodiment of the liquid-dispensing comb, designated as liquid-dispensing comb 510. The comb 510 is configured somewhat similarly to the combs 310 of FIG. 3 and 410 of FIGS. 4 and 5. The comb 510 has a spine 512 and a plurality of hollow, porous teeth 514. Each of the teeth has a solid, closed tip and a plurality of lateral pores (similar to the pores 318 of the comb 310 embodiment of FIG. 3). A hollow shank 516 extends from the base of the spine 512 of the comb, and a hollow handle 520 extends from the shank 516. The spine 514 may include a plurality of pores 518 therealong to provide further dispensing of liquid from the comb in addition to that provided from the lateral pores of the teeth 514. Liquid flow passes from the hollow handle 520 through the hollow shank 516 and hollow spine 512 of the comb, and out through the spinal pores 518 and lateral pores of the teeth 514 in the manner described further above for the liquid-dispensing comb embodiments 310 of FIG. 3 and 410 of FIGS. 4 and 5.

The hollow handle 520 includes an internal liquid storage cavity 522 therein. A plunger 524 of elastomer or other suitable material is slidingly disposed within the handle storage cavity 522, the edges of the plunger 524 making a good seal with the internal walls of the hollow handle 520. A spring 526 is seated in the distal end 528 of the hollow handle 520 and compressively urges the plunger 524 through the storage cavity 522 toward the spine 512 of the liquid-dispensing comb 510. The plunger 524 may be retained near the distal end 528 of the handle 520 by latches 530 extending inwardly from the inner walls of the hollow handle 520 near the distal end 528 thereof. The latches 530 may be selectively released by pressure on the external tabs 532 that extend from the handle 520 near the distal end 528 thereof, thereby allowing the spring 526 to push the plunger 524 through the internal cavity 522 of the handle 520 to expel any fluid therein from the pores of the comb teeth 514 and/or pores 518 of the spine 512. A retraction lever 534 extends from the edge of the plunger 524, the extension or connection between the plunger 524 and lever 534 traveling in a slot 536 formed along the side of the handle 520.

The liquid-dispensing comb 510 is used by first retracting the spring 526 and plunger 524 by means of the retraction lever 534 and capturing the plunger 524 with the internal latches 530 to maximize the internal volume 522 of the handle 520 between the plunger 524 and the shank portion 516. A filler port and cap 538 for filling the handle 520 is provided at the juncture of the handle 520 and shank 516. The cap 538 is removed, and the internal volume 522 of the handle 520 is filled with hair cream, foam, gel, or other liquid. The cap 538 is then replaced, and the plunger 524 is released by manipulating the external release tabs 532 adjacent the distal end 528 of the handle 520 to pressurize the contents of the handle 520 by means of the spring 526 and plunger 524. A dispensing control valve 540 of conventional configuration is provided at the juncture of the handle 520 and shank 516. Operation of the valve 540 opens the passage from the internal volume 522 of the handle 520 through the shank 516 to the dispensing pores of the comb teeth 514 and/or spinal pores 512, thereby dispensing the liquid from the pores as the spring 526 and plunger 524 urge the liquid within the internal volume 522 of the handle 520 toward the comb spine 512.

Figure 7:
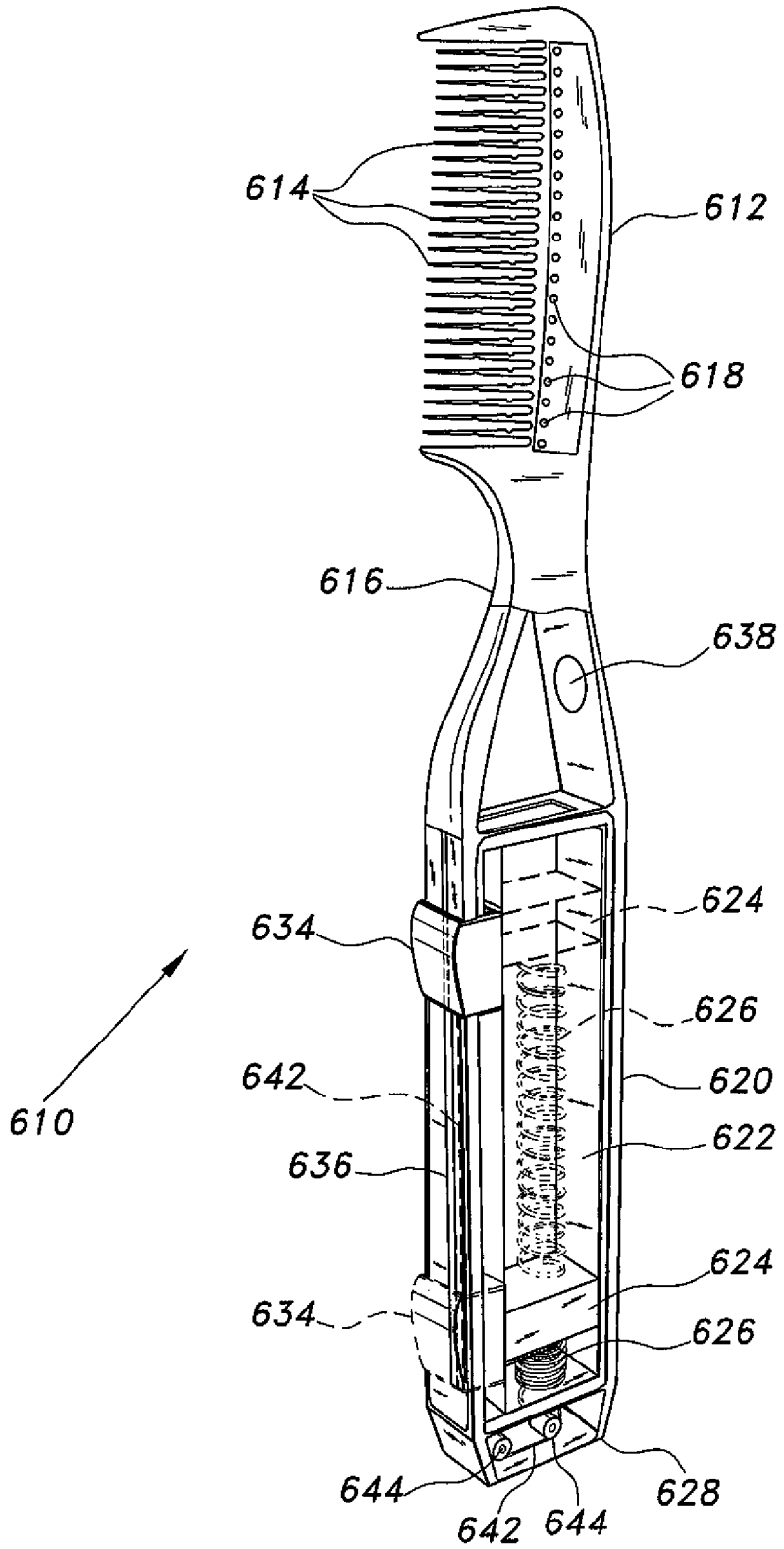
FIG. 7 is a perspective view of a sixth embodiment of a liquid-dispensing comb according to the present invention, shown with the handle broken away to show details thereof, illustrating a spring and draw cable mechanism disposed within the handle to dispense liquid from a reservoir contained within the handle.

FIG. 7 provides an illustration of a further embodiment of a liquid-dispensing comb, comprising a comb 610 having a hollow handle for the containment of water, hair tonic or gel, and/or other liquid. The comb 610 is configured somewhat similar to the combs 310 of FIG. 3 and 410 of FIGS. 4 and 5. The comb 610 has a spine 612 and a plurality of hollow, porous teeth 614. Each of the teeth has a solid, closed tip and a plurality of lateral pores (similar to the pores 318 of the comb 310 of FIG. 3). A hollow shank 616 extends from the base of the spine 612 of the comb, and a hollow handle 620 extends from the shank 616. The spine 614 may include a plurality of pores 618 therealong to provide further dispensing of liquid from the comb in addition to that provided from the lateral pores of the teeth 614. Liquid flow passes from the hollow handle 620 through the hollow shank 616 and hollow spine 612 of the comb, and out through the spinal pores 618 and lateral pores of the teeth 614 in the manner described further above for the liquid-dispensing comb embodiments 310 of FIG. 3 and 410 of FIGS. 4 and 5.

The liquid-dispensing comb 610 includes a hollow handle portion 620 extending from the head 612, as noted above. The handle 620 includes an internal liquid storage cavity 622 therein. A plunger 624 of elastomer or other suitable material is slidingly disposed within the handle storage cavity 622, the edges of the plunger 624 making a good seal with the internal walls of the hollow handle 620. A spring 626 is seated in the distal end 628 of the hollow handle 620 and compressively urges the plunger 624 through the storage cavity 622 toward the spine 612 of the comb 610.

The dispensing mechanism of the liquid-dispensing comb 610 differs from that of the comb 510 in that the lever or slide 634 along the side of the handle 620 is not directly connected to the plunger 624 within the handle. The slide or lever 634 rides or slides in a slot 636 through the side of the handle 620 and is connected to a cable, cord, or the like 642 that extends toward the distal end 628 of the handle to pass around a pair of rollers or pulleys 644 disposed within the distal end 628 of the handle, thence continuing up to attach to the bottom of the plunger 624, i.e., to the same side of the plunger that bears against the spring 626. The at-rest positions of the plunger 624 and slide or lever 634 are shown in broken lines in FIG. 7, and the compressive spring 626 is also shown in broken lines in its fully extended state.

The comb 610 is used by first retracting the spring 626 and plunger 624 by sliding the slide or lever 634 from its rest position near the distal end 628 of the handle 620 to its position as shown in solid lines near the shank 616 of the comb 610. This draws the cable or cord 642 upward along the slot 636, thereby drawing the cable 642 around the rollers or pulleys 644 to draw the plunger 624 to a position shown in solid lines toward the distal end 628 of the handle 620, thereby compressing the spring 626, as shown in solid lines in FIG. 7. The internal volume 622 of the handle 620 may then be filled with hair cream, foam, gel, or other liquid through the cap 638. The cap 638 is then replaced, and the plunger 624 is released by releasing the slide or lever 634 from its position shown in broken lines to allow the spring to push the plunger 624 toward the comb spine 612, thereby forcing the liquid contained within the handle 620 up through the shank 616 and comb spine 612 and out through the pores of the comb teeth 614 and/or spinal pores 618 to moisten the hair of the user of the liquid-dispensing comb 610.

Figure 8:
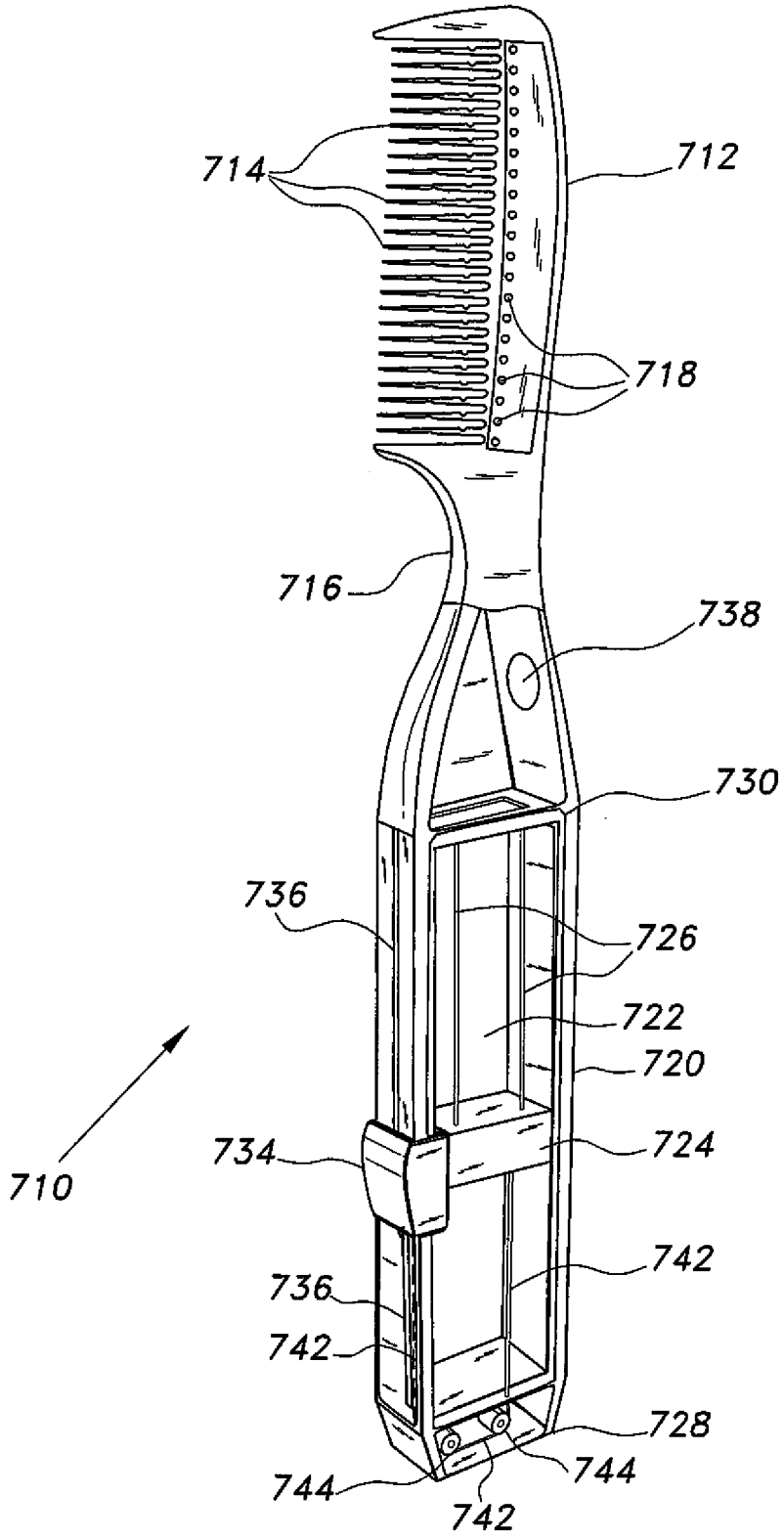
FIG. 8 is a perspective view of a seventh embodiment of a liquid-dispensing comb according to the present invention, shown with the handle broken away to show details thereof, illustrating an elastic band and draw cable mechanism disposed within the handle to dispense liquid from a reservoir contained within the handle.

FIG. 8 provides an illustration of a further embodiment of a liquid-dispensing comb, comprising a comb 710 having a hollow handle for the containment of water, hair cream, and/or other liquid. The comb 710 is configured somewhat similar to the combs 310 of FIG. 3 and 410 of FIGS. 4 and 5. The comb 710 has a spine 712 and a plurality of hollow, porous teeth 714. Each of the teeth has a solid, closed tip and a plurality of lateral pores (similar to the pores 318 of the comb 310 of FIG. 3). A hollow shank 716 extends from the base of the spine 712 of the comb, and a hollow handle 720 extends from the shank 716. The spine 714 may include a plurality of pores 718 therealong to provide further dispensing of liquid from the comb in addition to that provided from the lateral pores of the teeth 714. Liquid flow passes from the hollow handle 720 through the hollow shank 716 and hollow spine 712 of the comb, and out through the spinal pores 718 and lateral pores of the teeth 714 in the manner described further above for the liquid-dispensing comb embodiments 310 of FIG. 3 and 410 of FIGS. 4 and 5.

The liquid-dispensing comb 710 includes a hollow handle portion 720 extending from the shank 716. The handle 720 includes an internal liquid storage cavity 722 therein. A plunger 724 of elastomer or other suitable material is slidingly disposed within the handle storage cavity 722, the edges of the plunger 724 making a good seal with the internal walls of the hollow handle 720. One or more elastic bands or cords 726 extend from the plunger 724 to the upper end 730 of the hollow cavity or chamber 722 and draw the plunger 724 through the storage cavity 722 toward the head 712 of the comb 710.

The dispensing mechanism of the liquid-dispensing comb 710 differs from that of the comb 610. Rather than using a compressive spring, the comb 710 uses one or more elastomer bands or cords in tension. The slide or lever 734 rides or slides in a slot 736 through the side of the handle 720, and is connected to a cable, cord, or the like 742 that extends toward the distal end 728 of the handle to pass around a pair of rollers or pulleys 744 disposed within the distal end 728 of the handle, thence continuing up to attach to the bottom of the plunger 724, i.e., to the opposite side of the plunger from that connected to the elastomer cord(s) 726.

The liquid-dispensing comb 710 is used by first extending the elastomer cord(s) 726 and drawing the plunger 724 toward the distal end 728 of the handle 720 by sliding the slide or lever 734 from its rest position near the distal end 728 of the handle 720 to a position nearer the spine 712 of the comb 710. (The slide or lever 734 and plunger 724 are illustrated at an intermediate position in FIG. 8.) This draws the cable or cord 742 upward along the slot 736, thereby drawing the cable 742 around the rollers or pulleys 744 to draw the plunger 724 toward the distal end 728 of the handle 720, thereby extending the elastomer cord(s) 726. The internal volume 722 of the handle 720 may then be filled with shaving cream, foam, gel, or other liquid through the cap 738. The cap 738 is then replaced, and the plunger 724 is released by releasing the slide or lever 734 from its position shown in broken lines to allow the elastomer cord(s) 726 to draw the plunger 724 toward the hairbrush head 712, thereby forcing the liquid contained within the handle 720 up through the upper end 730 of the hollow handle cavity 722 and comb spine 712 and out through the pores of the teeth 714 and/or spinal pores 718 to moisten the hair of the user of the comb 710.

Figure 9:
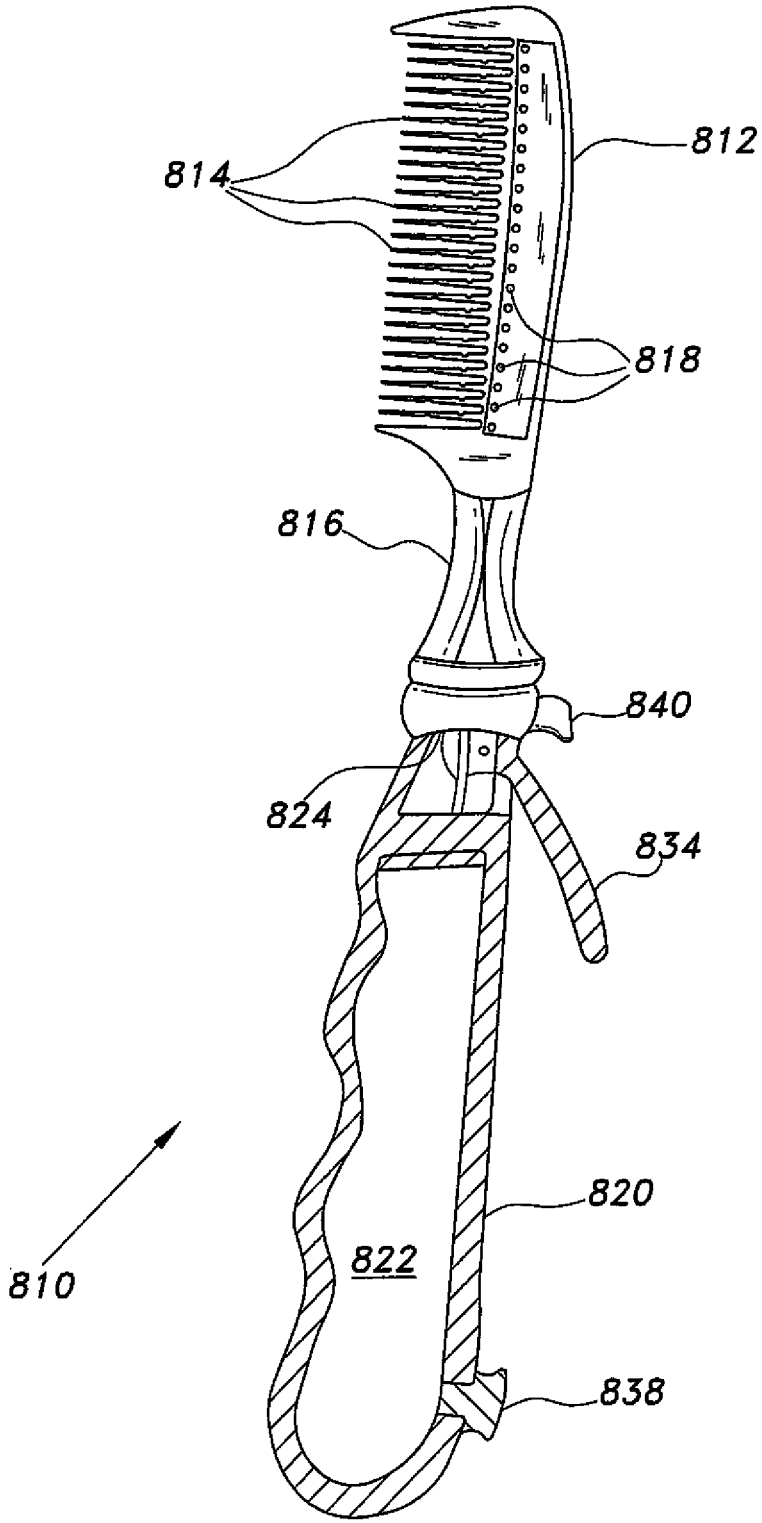
FIG. 9 is a perspective view of an eighth embodiment of a liquid-dispensing comb according to the present invention, shown in partial section, illustrating a manual pump mechanism disposed within the handle to dispense liquid from a reservoir contained within the handle.

FIG. 9 provides an illustration of a further embodiment of the liquid-dispensing hairbrush, comprising a liquid-dispensing comb 810 having a hollow handle for the containment of water, hair cream, and/or other liquid. The comb 810 is configured somewhat similar to the combs 310 of FIG. 3 and 410 of FIGS. 4 and 5. The comb 810 has a spine 812 and a plurality of hollow, porous teeth 814. Each of the teeth has a solid, closed tip and a plurality of lateral pores (similar to the pores 318 of the comb 310 embodiment of FIG. 3). A hollow shank 816 extends from the base of the spine 812 of the comb, and a hollow handle 820 extends from the shank 816. The spine 814 may include a plurality of pores 818 therealong to provide further dispensing of liquid from the comb in addition to that provided from the lateral pores of the teeth 814. Liquid flow passes from the hollow handle 820 through the hollow shank 816 and hollow spine 812 of the comb, and out through the spinal pores 818 and lateral pores of the teeth 814 in the manner described further above for the liquid-dispensing comb embodiments 310 of FIG. 3 and 410 of FIGS. 4 and 5.

The liquid-dispensing comb 810 includes a hollow handle portion 820 attached to the head 812 via the intermediate connecting shank 816. The handle 820 includes an internal liquid storage cavity 822 therein. Rather than using a plunger and other mechanism to urge or force liquid within the handle up toward the brush head, the comb 810 uses a small manually operated pneumatic pump 824 of conventional mechanism to pressurize the interior volume 822 of the handle 820. The pump 824 may be operated by using the thumb or finger to operate a lever 834. Prior to pressurizing the internal volume 822 of the handle 820, the internal volume 822 of the handle 820 may be filled with hair cream, foam, gel, or other liquid through the cap (similar to, e.g., the cap 538 of the liquid-dispensing comb embodiment 510 of FIG. 6). The cap is then replaced, and the pump 824 is actuated by means of the lever 834, thereby pressurizing the interior volume 822 of the handle 820 and forcing the liquid contained within the handle 820 up to the comb spine 812 and out through the hollow porous teeth 814 and/or spinal pores 818 to moisten the hair of the user of the comb 810. Control of the amount of liquid dispensed is provided by means of a dispensing control valve 840 of conventional configuration disposed at the pump 824, at the juncture of the handle 820 and shank 816. The control valve 840 may be of similar configuration to that of the valve 540 of the comb 510 of FIG. 6.

Embodiments of a liquid-dispensing comb may be used to apply various hair treatment liquids to the hair, from water to more specialized and/or exotic products, for example. However, embodiments of the liquid-dispensing comb are particularly desirable for the application of hair dye liquid to the hair, due to the small pores of the teeth and, as illustrated in the embodiment of FIG. 3, can also be along the spine of the liquid-dispensing comb. As the distal ends or tips of the teeth, i.e., those portions of the teeth of the comb that would normally come into direct contact with the scalp, are solid and relatively impervious, no dye or other liquid for hair treatment flows from the tips of the teeth directly onto the scalp. This can be an important consideration when dying the hair, as the embodiments of the present liquid-dispensing combs primarily allow the dye to directly contact only the strands of hair and, thus, substantially avoid the application of dye or other hair treatment liquid directly onto the scalp and, as such, may provide for a more natural appearance after treatment. Also, the embodiments of the liquid-dispensing comb can be relatively inexpensive to manufacture, particularly when an economical plastic material is used to form at least its basic components, such as the spine, handle, and teeth. While such plastic components may be washed or otherwise cleaned after use, the liquid-dispensing comb may be economically disposed of after use, if desired, such as to preclude the inadvertent application of residual dye or other product remaining therein in a subsequent use of the comb, for example.

It is to be understood that the present invention is not limited to the embodiments described above, but encompasses any and all embodiments within the scope of the following claims.

I claim:

1. A liquid-dispensing comb, consisting of:

a hollow spine having an internal reservoir;

a filler neck disposed along the spine, the filler neck communicating with the internal reservoir of the spine;

a handle extending from the spine, the handle formed of a solid structure;

a plurality of teeth extending generally normal to the spine, each of the teeth having a hollow passage extending therethrough, a plurality of laterally disposed pores distributed along substantially the length of each of the teeth, and a solid distal tip, each of the pores and the hollow passage of each of the teeth communicating with the reservoir of the spine;

a plate disposed within the reservoir of the spine;

a plurality of stops extending from the plate toward the passages of the teeth, each of the stops being respectively aligned with one of the passages of the teeth; and a flow adjustment handle extending from the plate and outwardly through the spine, wherein the plate is selectively adjusted by the flow adjustment handle to open and close the passages of the teeth by adjusting a position of the stops of the plate, to selectively control a flow of a liquid out from the reservoir;

wherein at least the spine, the handle, and the teeth are comprised of a plastic material.

* * * * *